US011643928B2

(12) United States Patent
Jones et al.

(10) Patent No.: US 11,643,928 B2
(45) **Date of Patent: *May 9, 2023**

(54) SIPHON PUMP CHIMNEY FOR FORMATION TESTER

(71) Applicant: Halliburton Energy Services, Inc., Houston, TX (US)

(72) Inventors: Christopher Michael Jones, Katy, TX (US); Darren George Gascooke, Houston, TX (US); Anthony Herman Van Zuilekom, Houston, TX (US); Etienne Marcel Samson, Cypress, TX (US); Michael Thomas Pelletier, Houston, TX (US); Mehdi Alipour Kallehbasti, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/539,725

(22) Filed: Dec. 1, 2021

(65) Prior Publication Data

US 2022/0090497 A1 Mar. 24, 2022

Related U.S. Application Data

(63) Continuation of application No. 16/754,189, filed as application No. PCT/US2019/023349 on Mar. 21, 2019, now Pat. No. 11,225,866.

(51) Int. Cl.
*E21B 49/08* (2006.01)
*E21B 34/06* (2006.01)
(Continued)

(52) U.S. Cl.
CPC ..... *E21B 49/087* (2013.01); *E21B 17/028* (2013.01); *E21B 34/06* (2013.01);
(Continued)

(58) Field of Classification Search
CPC ..... E21B 49/087; E21B 17/028; E21B 34/06; E21B 49/081; E21B 49/082; E21B 33/127
See application file for complete search history.

(56) References Cited

U.S. PATENT DOCUMENTS 4,633,952 A 1/1987 Ringgenberg
4,753,292 A 6/1988 Ringgenberg et al.
(Continued)

FOREIGN PATENT DOCUMENTS

EP 1264962 12/2002
WO 0208570 1/2002

OTHER PUBLICATIONS

U.S. Appl. No. 16/754,189 , "Corrected Notice of Allowability", dated Sep. 30, 2021, 2 pages.
(Continued)

*Primary Examiner* — Nicole Coy
(74) *Attorney, Agent, or Firm* — Kilpatrick Townsend & Stockton LLP

(57) ABSTRACT

A siphon pump chimney can be used in a mini-drillstem test to increase formation fluid flow rates. A formation tester can be coupled to a siphon pump chimney via a wet connect assembly to transfer formation fluid from a fluid-bearing formation. The siphon pump chimney can receive the formation fluid through the wet connect and disperse the formation fluid into a drill pipe that is flowing drilling fluid. The siphon pump chimney can include check valves to prevent the drilling fluid from entering the siphon pump chimney. The siphon pump chimney can be configured to have a variable height that can reduce pressure within the siphon pump chimney to a pressure value that can be close to or less than the formation pressure, which can allow a pump to operate at high flow rates or be bypassed in a free flow configuration.

20 Claims, 6 Drawing Sheets

(51) Int. Cl.
*E21B 17/02* (2006.01)
*E21B 33/127* (2006.01)

(52) U.S. Cl.
CPC ..... *E21B 49/081* (2013.01); *E21B 49/082* (2013.01); *E21B 33/127* (2013.01)

(56) References Cited

U.S. PATENT DOCUMENTS

| | | | |
|---|---|---|---|
| 5,799,733 | A | 9/1998 | Ringgenberg et al. |
| 6,325,146 | B1 | 12/2001 | Ringgenberg et al. |
| 7,004,252 | B2 | 2/2006 | Vise, Jr. |
| 8,132,621 | B2 | 3/2012 | Pettinato et al. |
| 8,528,394 | B2 | 9/2013 | Eriksen |
| 2011/0139450 | A1 | 6/2011 | Vasques et al. |

OTHER PUBLICATIONS

U.S. Appl. No. 16/754,189 , Non-Final Office Action, dated Jul. 26, 2021, 9 pages.
U.S. Appl. No. 16/754,189 , Notice of Allowance, dated Sep. 20, 2021, 8 pages.
Ayan et al., "A New Environmentally Friendly Technique to Extend the Limits of Transient Pressure Testing and Sampling Using Pipe Conveyed Open Hole Wireline Formation Testing Tools", Society of Petroleum Engineers, SPE-185867-MS, 2017, 29 pages.
PCT Application No. PCT/US2019/023349 , International Search Report and Written Opinion, dated Dec. 20, 2019, 11 pages.

SIPHON PUMP CHIMNEY FOR FORMATION TESTER

RELATED APPLICATIONS

This application is a continuation of U.S. application Ser. No. 16/754,189, filed Apr. 7, 2020, entitled "SIPHON PUMP CHIMNEY FOR FORMATION TESTER", which is a National Stage Application of PCT Application No. PCT/US2019/023349, filed Mar. 21, 2019, entitled, "SIPHON PUMP CHIMNEY FOR FORMATION TESTER", both of which are incorporated by reference herein.

TECHNICAL FIELD

The present disclosure relates to devices and methods usable in a wellbore environment. More specifically, this disclosure relates to using a siphon pump chimney with a formation tester to increase formation-fluid flow rates.

BACKGROUND

Hydrocarbon fluid identification, porosity characterization, and permeability can be used as input data for a strategy to determine intervals for drillstem tests ("DSTs") and robust hydrocarbon estimations. A DST is a technique for isolation and flowing fluid from a target formation to determine the presence and provide production rate characterization of hydrocarbon fluids. The data and samples obtained from a DST can be used to determine thickness, quality, and connectivity of the hydrocarbon zone, which can indicate viability of a well. Based on the DST, a decision as to whether to complete a well and produce hydrocarbons from one or more zones can be made. A DST can be costly and take considerable setup time prior to determining whether a well is viable for hydrocarbon production. Further, DST analysis may not be possible in many locations due to safety, environmental or logistical considerations.

A mini-DST can mimic a DST within a specific zone of the wellbore by isolating the target area with packers then pumping the formation fluid with a downhole pump outside of the isolated area. A mini-DST can be completed in less time and at lower cost than a DST. The Mini-DST may further mitigate issues related to safety, environmental and/or logistical considerations. However, a mini-DST may not provide as high of a flow rate as a DST. Therefore, lower pump rates of a mini-DST may cause a flow profile or pressure profile to change such that hydrocarbons a significant distance from the wellbore may not be accurately measurable, or may not be flowed quickly enough to justify implementation of a mini-DST instead of a conventional DST.

DETAILED DESCRIPTION

Figure 1:
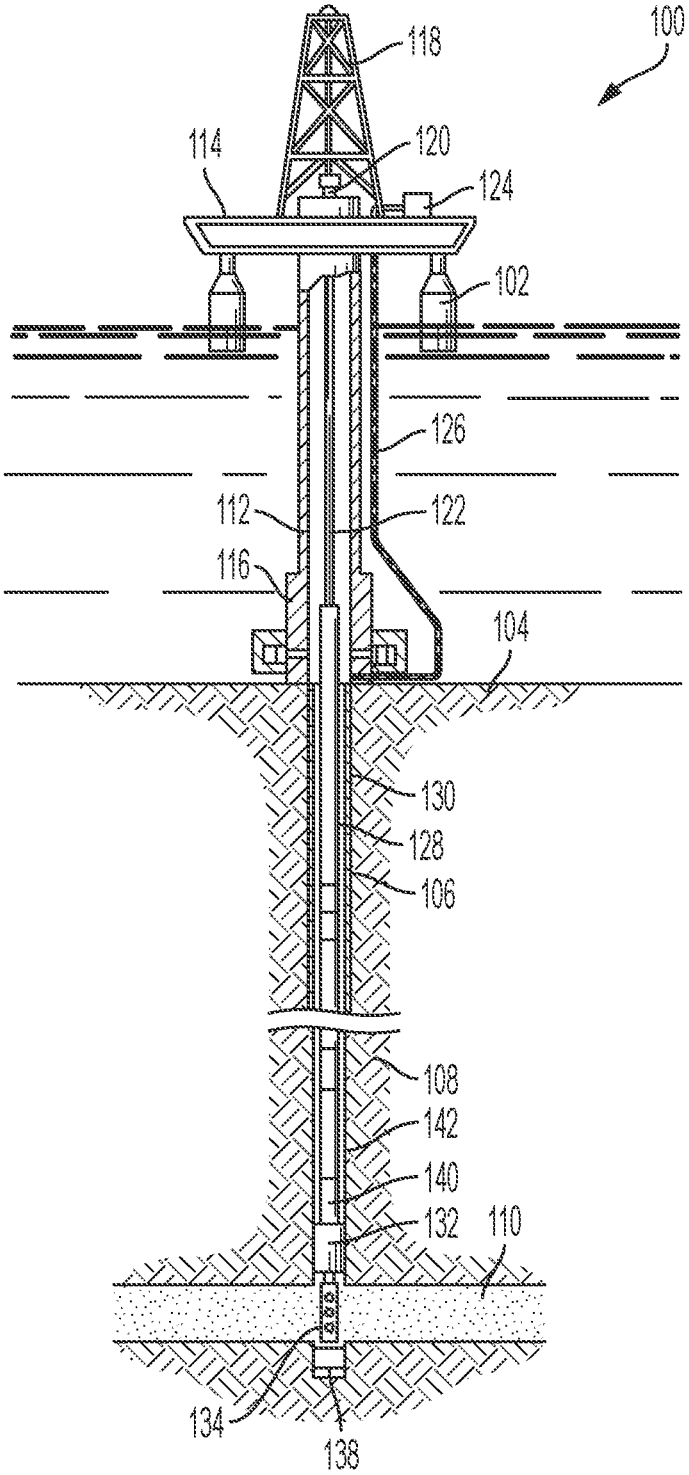
FIG. 1 is a cross-sectional view of an example of a wellbore drilling environment incorporating a formation tester according to some aspects of the present disclosure.

Certain aspects and features relate to using a siphon pump chimney with a formation tester to increase formation-fluid flow rates in a wellbore environment. A formation tester can be used to test the flow rate to determine a flow profile of a hydrocarbon fluid-bearing formation. A pump of the formation tester can pump the formation fluid from the formation tester and into the drilling fluid being dispersed through a drilling pipe. A siphon pump chimney can include a length of tubing fluidly connected to the pump so that the formation fluid can be dispersed into the drilling fluid while preventing the drilling fluid from entering the siphon pump chimney. The backing pressure of the formation tester pump can be reduced because of the height of the formation fluid volume within the siphon pump chimney created by the buffer between the formation fluid being pumped from the formation tester and the drilling fluid being pumped through the drilling pipe. Reducing the backing pressure on the formation tester pump can increase the pump rates, therefore allowing drillstem testing ("DST") and mini-DST to be performed in a reduced timeframe and over longer distances through a reservoir. Certain aspects of the embodiments can further reduce the backing pressure to provide for more accurate flow profiles in a shortened period.

When determining the viability of a well for hydrocarbon production, a DST or mini-DST can determine the potential production flow rates throughout various zones about the wellbore in a subterranean formation. DSTs and mini-DSTs can be applied during exploration of wells and in production wells prior to completion. A DST and mini-DST can be used to determine formation pressures, establish pressure gradients, identify reservoir fluid types, locate fluid contacts, calculate formation fluid mobility, collect representative reservoir-fluid samples, analyze reservoir fluid samples on site, and define reservoir architecture. One objective of a DST or mini-DST is to determine a pressure profile of hydrocarbons flowing from a fluid-bearing formation. The pressure profile measured by a DST or mini-DST can be used to anticipate a production flow rate after well completion. Further, the pressure profile may be used to optimize production strategies including production rates, completion design, and surface facilities. Thus, a higher flow rate measured consistently over time by a DST or mini-DST provide critical well design and planning information. Lower flow rates, inconsistent flow rates, and pressure profiles may indicate a less resource rich fluid bearing formation or the presence barriers that may restrict the flow during production. Generally the DST can reach the maximum extent of the reservoir to probe the entire reservoir, whereas the lower flow rates of the mini-DST are less likely to probe the entire extent of the reservoir.

During a DST or mini-DST, hydrocarbons can flow out of a fluid-bearing formation where that flow can correspond to a particular pattern. The longer and/or faster hydrocarbons flow from a fluid-bearing formation, the further out in the formation those flowed hydrocarbons will be sourced. If flowing for a long period, and/or when flowing large volumes, the flow can come from further out in a fluid-bearing formation that may reach a barrier eventually. A flow profile can change when a barrier affects a flow of hydrocarbons. A barrier can be some portion of a subterranean formation that may prevent a flow from reaching the expected flow for a fluid-bearing formation, altering the flow profile.

When encountering barriers or flows from significant distances from the wellbore, a DST may provide a sufficient pressure differential to continue to flow hydrocarbons at a steady rate with little or no impact on the flow profile, whereas a mini-DST may not. A conventional mini-DST may lack the pressure differential to continue to flow large volumes of hydrocarbons from the fluid-bearing formation past certain distance from the wellbore quickly enough, therefore not providing an accurate depiction of the total present hydrocarbons available for production. In some implementations, detecting a flow profile indicating a barrier can help determine the capacity of a fluid-bearing formation and whether the fluid-bearing formation is economically viable for production. However, if that barrier is too distant from the wellbore (e.g., a kilometer or greater from the wellbore), a mini-DST may not be able to provide a sufficient pressure differential over a period to detect the barrier, and cannot be used to determine the extent of the fluid-bearing formation.

Seismic surveys can be used to detect changes throughout subterranean formations, but may not provide an accurate indication of whether a change in the formation is a fault, and if that potential fault is a sealing fault, or barrier, that would seal hydrocarbons within the fluid-bearing formation. DSTs and mini-DST can provide a more accurate depiction of whether the fault is a barrier.

Compared to DSTs, mini-DSTs can be less time and resource consuming. Additionally, DSTs may be difficult to perform under certain environmental conditions (e.g., isolated surface locations that are difficult to transport equipment too, turbulent waters for subsea drilling environments, etc.), whereas mini-DSTs can be more versatile. However, conventional mini-DSTs cannot provide the same flow rates as in conventional DSTs. Certain embodiments provide for increasing flow rates when implementing mini-DSTs to ensure a steady flow profile over long distances and when encountering barriers. Embodiments can provide an aid to pumping action for wireline formation testers in order to obtain high pump rates for mini-DSTs in permeable formations. Further, in some embodiments, the pumping aid may reduce the load on associated formation tester pumps. Additionally, some embodiments can more efficiently disperse gas, condensate, volatile oil, or light oil into water-based drilling fluid under conditions where dispersion and/or solubility is not favorable, such as shallow low-pressure testing.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts a cross-sectional view of a wellbore drilling environment 100 incorporating a formation tester 134 according to one example.

A floating work station 102 can be centered over a submerged oil or gas well located in a sea floor 104 having a wellbore 106 which can extend from the sea floor 104 through a subterranean formation 108. The subterranean formation 108 can include a fluid-bearing formation 110. A subsea conduit 112 can extend from the deck 114 of the floating workstation 102 into a wellhead installation 116. The floating workstation 102 can have a derrick 118 and a hoisting apparatus 120 for raising and lowering tools to drill, test, and complete the oil or gas well. The floating workstation 102 can be an oil platform as depicted in FIG. 1 or an aquatic vessel capable of performing the same or similar drilling and testing operations. In some examples, the processes described herein can be applied to a land-based context for wellbore exploration, planning, and drilling.

A testing string 122 can be lowered into the wellbore 106 of the oil or gas well. The testing string 122 can include tools for testing, drilling, and production phases such as a wireline logging and formation tester, Measuring-while-drilling ("MWD") and Logging-while drilling ("LWD") tools and devices. A pump 124 located on the deck 114 can exert fluid annulus pressure. Pressure changes can be transmitted by a pipe 126 to the well annulus 128 located between the testing string 122 and the well casing 130 or an open hole wall 142. The open hole wall 142 can be created by drilling the wellbore 106. The well casing 130 can separate the annulus 128 from the open hole wall 142. The well casing 130 can be disposed downhole from the top of the wellbore 106 and may extend downwards towards the fluid-bearing formation 110. The well casing 130 may not extend to a depth in the wellbore at which the fluid-bearing formation 110 is located, such that the well casing 130 does not enter the test zone. In some examples during the exploration phase of a new wellbore, a well casing 130 may not be implemented during initial testing and only the open hole wall 142 may exist. A probe such as a packer 132 or other probe such as a pad or multiple combinations therein can isolate well annulus pressure from the fluid-bearing formation 110 being tested by creating a seal against the bare rock formation of the open hole wall 142, where the packer is located at a height above the fluid-bearing formation 110.

A formation tester 134 may be run via wireline to or may be disposed on a tubing string at the lower end of testing string 122 to perform and record fluid characteristic measurements at the fluid-bearing formation 110. A DST can be performed by controlling and measuring the flow of fluid from the fluid-bearing formation 110 using the formation tester 134.

In some examples, a mini-DST may be performed by isolating the fluid-bearing formation 110 from the other portions of the wellbore 106 using the packer 132 above the fluid-bearing formation 110 and a packer 138. A downhole pump 140 can pump formation fluid sourced from the fluid-bearing formation 110 through the formation tester 134 and past the packer 132 up to the testing string 122. Once pumped out of the isolated zone created by the packers 132, 138, the formation fluid can be measured by various downhole or surface sensors or devices to determine a flow profile, among other formation fluid properties. In examples where the formation tester 134 was conveyed into the wellbore 106 using a wireline, downhole sensors and devices of the formation tester 134 can transmit and receive information corresponding to the pumped formation fluid via the wireline.

Figure 2:
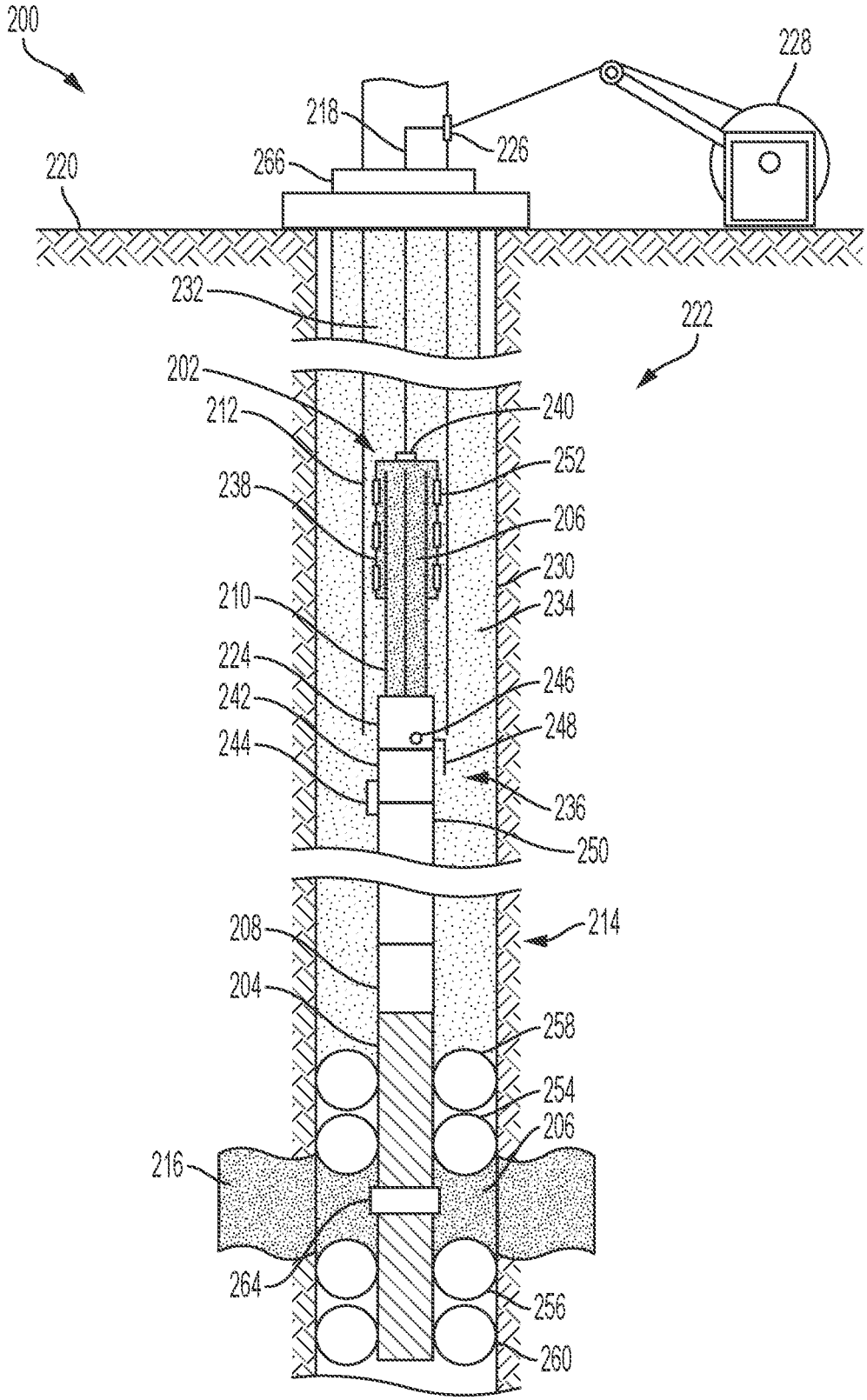
FIG. 2 is a cross-sectional view of an example of a mini-drillstem test ("DST") system implementing a siphon pump chimney for increasing the formation fluid flow rates according to some aspects of the present disclosure

FIG. 2 depicts a cross-sectional view of a mini-DST system 200 implementing a siphon pump chimney 202 for increasing formation-fluid flow rates according to one example. Although the siphon pump chimney 202 is depicted as being installed with a wireline, the processes described herein can be implemented in LWD or coiled tubing applications. The mini-DST system 200 provides for enhancing the volume and flow rate of formation fluid 206 through a formation tester 204. For example, the pump 208 may achieve flow rates of higher than 160 cc/sec. The flow rate of the formation fluid 206 from a fluid-bearing formation 216 can be increased during a mini-DST using various downhole tools and devices. For example, the siphon pump chimney 202 can be fluidly connected to a pump 208 that flows formation fluid 206 from the formation tester 204. The siphon pump chimney 202 can be fluidly connected to the pump 208 using a wet connect assembly 236 including various custom-mating components and purge ports.

In some examples, the pump 208 can operate at higher formation fluid transfer rates while preventing a blowout by reducing the backing pressure on the pump 208. The backing pressure may be lowered to a level above or below the formation pressure, but the improvement can still be realized even when lowering the backing pressure to a level that is still higher than the pressure of the formation fluid 206 at the formation tester 204 and can increase the flow rate of the pump 208. Reducing the backing pressure at the pump 208 can allow the pump 208 to be configured to operate with a lower pressure differential than if the backing pressure was not reduced. In some examples, In some examples, the backing pressure on the pump 208 can be reduced to a level that is lower than the pressure of the formation fluid 206 at the formation tester 204. The siphon pump chimney 202 can be of a sufficient vertical length such that the height at which the formation fluid 206 is dispersed into the drill pipe 212 via the siphon pump chimney 202 causes a natural gravimetric pressure drop. The pump 208 can act as a passive device for the free flow of formation fluid 206 when the pressure above the pump 208 is less than the pressure of the formation fluid below the pump 208. In some examples, the pump 208 can act as a metering device or flow controller when bypassed to limit the free flow of formation fluid 206 to the siphon pump chimney 202. Production of hydrocarbons in a pump-bypassed configuration may be quiet with respect to pump noise and pressure noise.

A wellbore 214 can be created by drilling through a hydrocarbon-bearing subterranean formation 222 including various earth strata. An open hole wall 230 can extend from a well surface 220 into the subterranean formation 222, such that the open hole wall 230 is the result of drilling the wellbore 214. A drill string or drill pipe 212 can be lowered into the wellbore 214 from a wellhead 266 at the well surface 220. The drill pipe 212 can be used to lower downhole equipment for drilling and testing within the wellbore 214. Drilling fluid 232 can be pumped into the wellbore 214 downward through the drill pipe 212. The drilling fluid 232 can exit the bottom of the drill pipe 212 into an annulus 234. The drilling fluid 232 can move vertically upward through the annulus 234 between the exterior of the drill pipe 212 and the open hole wall 230 as more drilling fluid 232 is pumped, exerting pressure downhole through the drilling pipe 212.

The drill pipe 212 can be coupled to and/or include various downhole tools and equipment during drilling and testing wellbore operational phases. For example, the formation tester 204 can be coupled to the bottom of the drill pipe 212 during operations including those of a mini-DST. The formation tester 204 can be positioned within a wellbore 214 at a location adjacent to a fluid-bearing formation 216 by lowering the drill pipe 212 into the wellbore 214 from the wellhead 266 at the well surface 220.

A wireline 218 can be used to lower various downhole tools and equipment into the wellbore 214. The wireline 218 can be lowered into the drill pipe 212 through a side entry sub 226 via a reel 228 located at the well surface 220. In some examples, coiled tubing can be used to provide additional siphoning and fluid communication functions. The coiled tubing can be wrapped around the wireline 218, or the wireline 218 can be inserted into coiled tubing, such that the paired combination of the wireline 218 and coiled tubing can be raised from or lowered into the wellbore simultaneously. The paired combination of the wireline 218 and the coiled tubing can be recoiled around the reel 228.

A wireline 218 can be coupled to a wireline head wet connect 224. In examples implementing a paired combination of the wireline 218 and coiled tubing, the coiled tubing can be fluidly coupled to the wireline head wet connect 224. The wireline head wet connect 224 is a component of the wet connect assembly 236 that can allow for forming an electrical and/or hydraulic connection within a fluid filled environment such as the annulus 234. The wireline 218 and coiled tubing can be connected to the wireline head wet connect 224 forming a siphon pump chimney 202. The connection action of the wireline 218 versus the coiled tubing may be simultaneous. Alternatively, the wireline 218 and coiled tubing may be connected by independent wet connects to the wireline head wet connect 224.

The siphon pump chimney 202 can include the tubing 210 and a tubing head 238. The tubing 210 and/or the tubing head 238 may be hundreds to thousands of meters along the wireline 218 to create a natural pressure differential over the total height. The tubing 210 can receive the formation fluid 206 from downhole equipment such as the formation tester 204. The tubing 210 can have a tubing opening to convey the formation fluid 206 in an upwards direction to the tubing head 238. The tubing head 238 can have walls creating an annulus extending downwardly around the tubing 210 at a length below the tubing opening. This can allow the formation fluid 206 that is conveyed in an upwards direction from the tubing opening to be flushed into the annulus between the tubing 210 and the walls of the tubing head 238. The walls of the tubing head 238 can include one or more orifices to disperse the formation fluid from the annulus to the drill pipe. This dispersing action can lower regions in the drilling fluid of high formation fluid concentration for safety reasons. These safety reasons include maintaining an even density of drilling fluid formation fluid mixture as to maintain hydraulic pressure on the open hole formation, thereby preventing a blowout situation.

The tubing head 238 can include a wireline-to-tubing seal 240 that can allow for the conveyance of the wireline 218 while preventing drilling fluid 232 in the drill pipe 212 from entering the siphon pump chimney 202. The wireline 218 and siphon pump chimney 202 can be lowered simultaneously such that both components can reach and be communicatively coupled to the wireline head wet connect 224 substantially contemporaneously.

The wet connect assembly 236 can include various subcomponents to mate downhole subassemblies and provide fluid purging port. In addition to the wireline head wet connect 224, the wet connect assembly can include a wet latch 242, a hydraulic line jumper 244, a wet connect purge port 246, and an optional purge port 248.

The wet latch 242 can be configured to receive a mating end of the wireline head wet connect 224, where the mating end may be referred to as a wet connect stinger. Insertion of the mating end of the wireline head wet connect 224 into the wet latch 242 can allow for the wireline 218 to be in electrical communication with any reservoir description tool ("RDT") or other downhole tool coupled to the opposite end of the wet connect assembly 236. For example, the formation tester 204 or pump 208 can be in electrical communication with any wellbore surface equipment connected via the wireline 218 after mating the wireline head wet connect 224 and the wet latch 242.

Coupling the wireline head wet connect 224 and the wet latch 242 can create a hydraulic pathway for formation fluid 206 to be conveyed through to the siphon pump chimney 202. The hydraulic line jumper 244 can fluidly connect the exit port of the formation tester 204 and the wet latch 242. For example, the hydraulic line jumper 244 can communicate the formation fluid 206 from the formation tester purge port extender 250 to the siphon pump chimney 202 through the pathway formed by mating the wireline head wet connect 224 and the wet latch 242.

The electrical connection to the wireline 218 and the hydraulic connection to the wet latch 242 via the hydraulic line jumper 244 can be conveyed through the formation tester purge port extender 250. The formation tester purge port extender 250 can, for example, connect a last section of a multichamber section ("MCS") (e.g., wet latch 242) with a section normally including the exit port of the formation tester 204 that conveys the formation fluid 206.

The wet connect purge port 246 can connect to the formation tester 204 directly to purge the contents of the hydraulic line from the formation tester 204 into the annulus 234. This can prevent undesirable contents such as mud located within the hydraulic line between the formation tester 204 and the wet connect purge port 246 from being introduced into the siphon pump chimney 202. The wet connect purge port 246 can also be used to purge coiled tubing connected to the wireline head wet connect 224. In some examples, the wet connect assembly 236 can include the optional purge port 248 that can be used as a primary and dedicated purge port for the formation tester 204 hydraulic line. When implementing an optional purge port 248, the wet connect purge port 246 can be dedicated to purging the coiled tubing, thus eliminating the need for additional valves or devices necessary to switch between purging the coiled tubing and formation tester 204 hydraulic line. In some examples, the optional purge port 248 may be located gravimetrically below the formation fluid entrance to the tubing 210.

The pump 208 can pump the formation fluid 206 up through the wet connect assembly 236 to the siphon pump chimney 202 after mating establishing a hydraulic connection. The tubing head 238 of the siphon pump chimney 202 can include one or more exit orifices, such as exit orifice 252, to disperse the formation fluid 206 into the drill pipe 212. The exit ports can disperse the formation fluid 206 the drilling fluid 232 to prevent the buildup of large bubbles or slugs within a circulating mud column. As the formation fluid 206 is dispersed into the drill pipe 212, the flow of the drilling fluid 232 can push the formation fluid 206 out of the bottom of the drill pipe 212 and into the annulus 234.

The exit orifices can include check valves to control the dispersal of the formation fluid into the drill pipe 212 while preventing the drilling fluid 232 from entering the siphon pump chimney 202. The check valves can withstand pressure differentials between the drilling fluid 232 and formation fluid 206 to prevent a blowout. The exit orifices and any corresponding check valves can be located anywhere along the length of the siphon pump chimney 202. This can allow for control of the effective height of the siphon pump chimney 202 by opening and closing specific check valves along the length of the siphon pump chimney 202. Adjusting the height of the siphon pump chimney 202 can allow for the control of the backing pressure against the pump 208, which can affect the flow rate of the pump 209. Where flow rates of the drilling fluid 232 are fast, dispersal elements such as check valves may not be necessary at the exit orifices to prevent the drilling fluid 232 from entering the siphon pump chimney. Where flow rates of the drilling fluid 232 are slow, dispersal elements may be implemented to prevent a blowout.

The wet connect purge port 246 and the optional purge port 248 can include check valves similar to those implementable at the exit orifices of the tubing head 238. The purge port and exit orifice check valves may be automated based on fluid sensing (e.g., resistivity, thermal, etc.), pressure, or operated in timed intervals. The check valves may be battery operated, and/or commands may be sent directly to the valves by inductive transients.

The mini-DST system 200 can implement one or more packers for isolation and bladder control around the formation tester 204. Packers can be used to isolate the formation fluid 206 at the formation tester 204 and prevent the formation fluid 206 from travelling throughout the annulus 234. Inlet packers 254, 256 can inflate to provide a hydraulic seal between the formation tester 204 and the open hole wall 230. The formation tester 204 can intake the formation fluid 206 through the formation fluid inlet 264 via siphoning action of the pump 208 to measure characteristics of the formation fluid 206. The seal created by the inlet packers 254, 256 can allow the formation tester 204 to receive the formation fluid 206 in the formation fluid inlet 264 while preventing the formation fluid from entering other portions of the annulus 234 that may cause a blowout. In some examples, the inlet packers 254, 256 can include sensors or devices to gather information about the formation fluid 206 and operating conditions of the formation tester 204.

In some examples, additional sets of packers may be used to dampen low frequency pressure noise from the annulus 234 containing drilling fluid 232. Outer packers 258 and 260 may be placed and inflated to further separate contents within the annulus 234 (e.g., mud column) from the formation fluid 206 sourced from the fluid-bearing formation 216 being tested. The outer packers 258 and 260 can provide hydraulic dampening for pressure measurements. A pressure measurement with sufficient resolution for detecting fluid-bearing formation 216 architecture a large distance from the wellbore can be made when the total flow and the pressure drop values are sufficient for (i) the resolution of the pressure gauges and (ii) the inherent noise of the wellbore. For example, if the resolution of the pressure gauges is ideal, but the wellbore 214 is still noisy in terms of pressure, then the limit on the pressure drop that is to be induced by the pump 208 can be determined by the noise of the wellbore 214 and not the resolution of the pressure gauge. If the wellbore 214 has significantly low-pressure noise, then the limit on the pressure drop to be induced is based on the resolution of the pressure gauges. The outer packers 258, 260 can function as dampeners to reduce the pressure noise of the wellbore 214 so that the induced pressure drop does not need to be as large to flow formation fluid 206 at large distances from the wellbore 214. In some examples, more than one set of outer packers can be implemented to reduce the pressure noise of the wellbore further, which can further reduce the induced pressure drop. Lowering the induced pressure drop can allow the pump 208 to flow the formation fluid 206 at faster rates.

Figure 3:
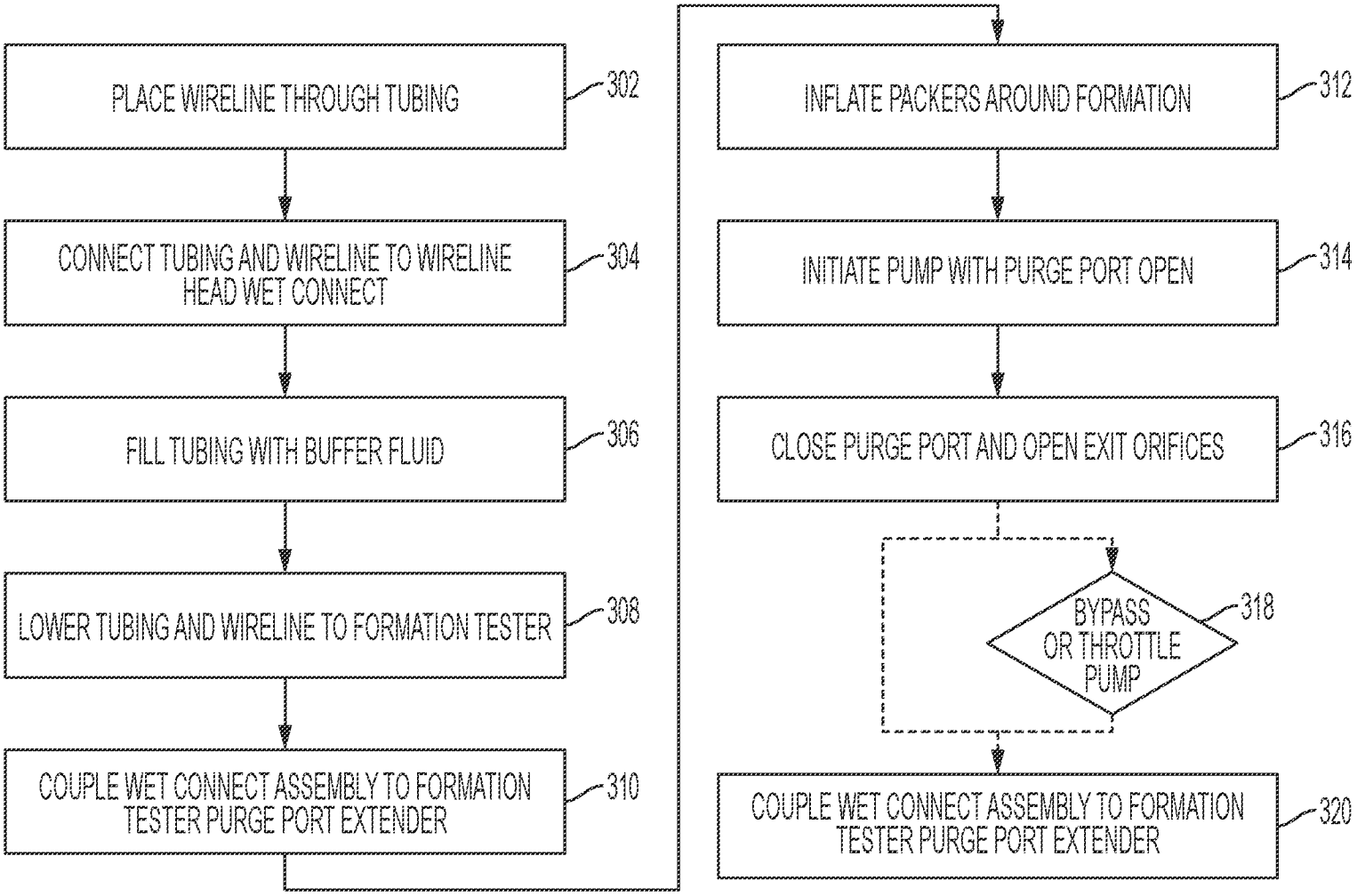
FIG. 3 depicts a flowchart of a process for implementing a siphon pump chimney, wet connect assembly, and formation tester to increase formation fluid flow rates during a mini-DST according to some aspects of the invention.

FIG. 3 depicts a flowchart of a process for implementing a siphon pump chimney, wet connect assembly, and formation tester to increase formation fluid flow rates during a mini-DST according to one example. Some of the following steps may be performed in any order with respect to the other steps as would be understood by one of ordinary skill in the art.

The following steps describe how the backing pressure can be reduced on the hydrostatic mud column side of a formation tester pump by reducing the pressure at the purge point of the formation tester. The backing pressure of the pump can be reduced to approximately that of the formation pressure, and may be either greater or lower than that of the formation pressure. The pressure can be reduced with the aid of a length of tubing, which surrounds the wireline and is connected to the formation tester as part of the downhole wireline cable wet connect. If the length of tubing is chosen correctly, the density difference between the hydrostatic mud column and the density of the fluid in the tubing may be sufficient to lower the backing pressure to near formation pressure. In some examples, the length of the tubing may lower the backing pressure of the pump below that of the formation pressure. As the backing pressure of the pump is lowered, the pump can operate at high rates.

In block 302, a wireline is placed through tubing and positioned downhole. The wireline can be paired with coiled tubing and unspooled into the drill pipe via a side entry sub as described in examples. The wireline can be conveyed through a siphon pump chimney and fluidly sealed from any contents within the drilling pipe such as drilling fluid, or mud.

In block 304, the tubing and wireline is connected to the wireline head wet connect. The wireline and corresponding tubing can be lowered through the side entry sub to a wireline tool, such as a formation tester, at a specific depth within the wellbore. The wet connect assembly can establish an electrical connection with the wireline. The wet connect assembly can establish a hydraulic connection using a modified portion of the wet connect.

In block 306, the tubing is filled with a buffer fluid. The tubing may be filled with a buffer fluid of sufficiently low density as to overcome the hydrostatic overbalance backing pressure on the pump without priming the tubing. The buffer fluid can prevent wellbore fluids such as mud from entering the tubing prior to establishing the hydraulic connection with the wet connect assembly. Buffer fluids may include water, oil-based mud ("OBM"), air, nitrogen, or other incompressible liquid or gas.

For configurations where the tubing is filled with a buffer fluid, the wireline wet connect assembly may have a protective valve that opens after the wet connect is made to disperse the buffer fluid into the mud column. For example, because coiled tubing may not be conveyed downhole already containing formation fluid, the wet connect assembly can include a primer to pump out fluid such as a buffer fluid that is contained inside the coiled tubing. If the buffer fluid is not evacuated from the coiled tubing before pumping the formation fluid from the fluid-bearing formations, then the coiled tubing may be subject to locking and may not generate a siphon action. In some examples, the buffer fluid can be a buffer gas, which may not need to be evacuated to avoid coiled tubing malfunctions.

In block 308, the tubing and wireline is lowered to the formation tester. The wireline and coiled tubing along with the now connected wet connect assembly can be lowered into the wellbore through the side entry sub until reaching the location of the formation tester. As described in examples, the wireline and coiled tubing can be spooled onto a single reel that can be used to lower the pair downhole at the same rate.

In block 310, the wet connect assembly is coupled to the formation tester purge port extender. The wet connect assembly can be hydraulically coupled to the formation tester purge port extender using a hydraulic line jumper as described in examples. The connection made by lowering the wet connect assembly into the formation tester purge port extender can be made after setting the location for the formation tester, by adjusting the drill pipe, to be adjacent to a suspected fluid-bearing formation. The hydraulic line jumper of the wet connect assembly can connect to an exit port of the formation tester or the formation tester purge port extender acting as the exit port. The connections established by the wet connect assembly can allow for the transfer of formation fluid from the formation tester to the siphon pump chimney for eventual dispersal into the mud column.

In block 312, the packers are inflated around the formation. The packers can be inflated around the formation tester prior to the formation tester performing formation fluid characteristic measurements and prior to the pump siphoning the formation fluid. The packers can provide a hydraulic seal to prevent the flow of the formation fluid from the testing point to surrounding areas within the wellbore containing mud. Additional packers may be used to provide pressure noise isolation as described in examples.

In block 314, the pump is initiated with a purge port open. A liquid purge port such as a wet connect purge port can be used to flush liquid that is not formation fluid from the formation tester. To purge liquids via the liquid purge port, a top of the tubing, or a section above the liquid line, can be closed temporarily in order to build pressure from the formation fluid being pumped. Thus, the pump does not fill the coiled tubing with formation fluid when the pump begins pumping, but the formation fluid is instead ejected through the liquid purge port. The pressure provided by the pump flowing the formation fluid from formation tester can push non-formation fluid out through the liquid purge port and into the mud column. This can prevent mud and other non-formation fluid contents from filling the coiled tubing when being lowered into place.

The drilling fluid or mud can be flowed into the wellbore when the pump forces non-formation fluid contents out through the liquid purge port and into the mud column. This allows the purged non-formation fluid contents to be dispersed within the flowing mud column. In some examples, the flow of drilling fluid can be withheld until after pump priming during which the pump builds up sufficient pressure to force the non-formation contents out of the formation tester.

After the formation tester has been sufficiently flushed of non-formation fluid contents and has been filled with formation fluid, a valve in the wet connect assembly can actuate to allow the pump to prime the coiled tubing with formation fluid. The coiled tubing can be filled with formation fluid over a sufficient distance from hundreds to thousands of meters from the pump. In some formations, for instance unusually shallow formations, tens to hundreds of meters may be desirable. The vertical height of the tubing and the pressure of the formation fluid in the coiled tubing can create a sufficiently low hydrostatic pressure differential between the pressure value at the top of the siphon pump chimney and the pressure value at the pump. One method of calculation of the pressure differential can be represented as $\Delta P=\Delta\rho*g*\Delta h$, where $\Delta\rho$ is the fluid density difference in kilograms per cubic meter between the fluid in the chimney and the fluid outside the chimney, g is acceleration due to gravity in meters per second squared, and $\Delta h$ is the height differential between the pump location and the top of the siphon pump chimney. Other methods may calculate the density as a profile using more advanced methods such as a thermodynamic cubic equation of state, or make fluid measurements in situ. This lower pressure over a large height can allow the pump to operate at a higher rate, since the backing pressure has been lowered allowing for decreased resistance that the pump must overcome when trying to reach a certain formation fluid flow rate. For example, the pump can operate at rates of 300 cc/second, whereas a mini-DST pump in a conventional setting may operate at rates of 40 cc/second. To accommodate the higher pump rate it can be necessary to modify the pump configuration in a complimentary fashion, which, for example, may include changes to firmware, rate of pump valve operation, pump stroke speed, pump hydraulic fluid, pump cylinder volumes, or cylinder/piston diameters.

In block 316, the liquid purge port is closed and exit orifices are opened after purging the formation tester and tubing. Once the formation tester and coiled tubing have been purged of non-formation fluid contents and have been primed with formation fluid, the liquid purge port can be closed and the exit orifices located in the siphon pump chimney can be opened. The exit orifices can include valves to adjust the transfer rate of formation fluid from within the siphon pump chimney into the drill pipe containing the flowing mud column. Selectively transferring the formation fluid from the siphon pump chimney into the drill pipe can allow for manual or automated control of the pressure differential between the pressure value of the formation fluid at the top of the siphon pump chimney and the pressure value of the formation fluid being pumped at the pump. By controlling the pressure differential, the backing pressure on the pump can be controlled in a steady state or altered, which can allow pump flow rates to be controlled. Thus, the pump can begin to perform the mock-production of hydrocarbons at increased flow rates allowable by a reduced backing pressure.

In some examples, block 318 may be performed. In block 318, the pump is bypassed and enters a free-flow or throttling state. If the backing pressure of the pump is lowered below the formation pressure at the formation tester, the formation fluid can flow from the formation tester to the tubing since the pump would not need to pump against a resistance caused a higher backing pressure. In this configuration, the pump may be used to throttle the formation fluid flow from the formation. Alternatively the pump may be bypassed, and instead a variable orifice or flow controller in the wet connect can be used to variably throttle the formation fluid flow from the fluid-bearing formation into the tubing. This configuration allows for the production of formation fluid in an environment with less pressure noise, where a production rate higher than a pump rate may be achieved.

In block 320, the production rate of formation fluid is measured by the formation tester. The formation tester and/or pump can communicate a formation fluid flow rate to the surface of the wellbore using the wireline. Various downhole sensors and measurement devices other than the formation tester and pump (e.g., packer sensors, valve statuses, wet connect meter, fluid analysis sensors at wireline head wet connect and/or siphon pump chimney, etc.) in electrical communication with the wireline can help measure and record system-wide formation fluid flow rates and formation fluid characteristics. For example, formation fluid characteristics of fluid density, fluid phase, and linear speed can be used to calculate a production rate.

Fluid analysis sensors in the wireline head wet connect and/or siphon pump chimney can (i) monitor the type of fluid present, such as a buffer fluid versus formation fluid for determining when the non-formation fluid purge is complete, and to (ii) detect phase changes within formation fluid. Phase changes within the formation fluid between the wet connect and the siphon pump chimney can be caused by large pressure changes. By monitoring the formation fluid phase between the siphon pump chimney and wet connect, steps can be performed to prevent gas from evolving outside of liquid within the formation fluid and to prevent liquid from dropping out of the gas. Preventative a phase change may include realigning the formation fluid pressure by adjusting the flow rate via the pump or a metering controller in a pump-bypassed configuration, or adjusting the height of the siphon pump chimney by opening and closing check valves at exit orifices at various heights. In some examples, the wet connect can include a phase separator to separate the liquid phase of the formation fluid from the gas phase of the formation fluid. This can be implemented in examples where multiple phases are sourced from a fluid-bearing formation.

In examples where the pump is used to throttle the formation fluid flow rate or the pump is bypassed, the production rate of fluid from the formation may be measured directly by the pump throttle or based on a metering device such as a spinner located in the wet connect assembly. The wet connect variable orifice or flow controller may be pre-programed to maintain a desired linear speed or production rate. The production rate may further be determined by monitoring the gas rate, the rate of fluid dilution with oil, and circulation rate. A quantitative mud-gas trap may be used to analyze these parameters. Based on the flow rates of formation fluid at the formation tester, the pump and/or check valves along the siphon pump chimney can be controlled to maintain or alter the flow rates. In some examples, a sample of the formation fluid can be taken and formation pressure buildup can be monitored during the mini-DST.

Figure 4:
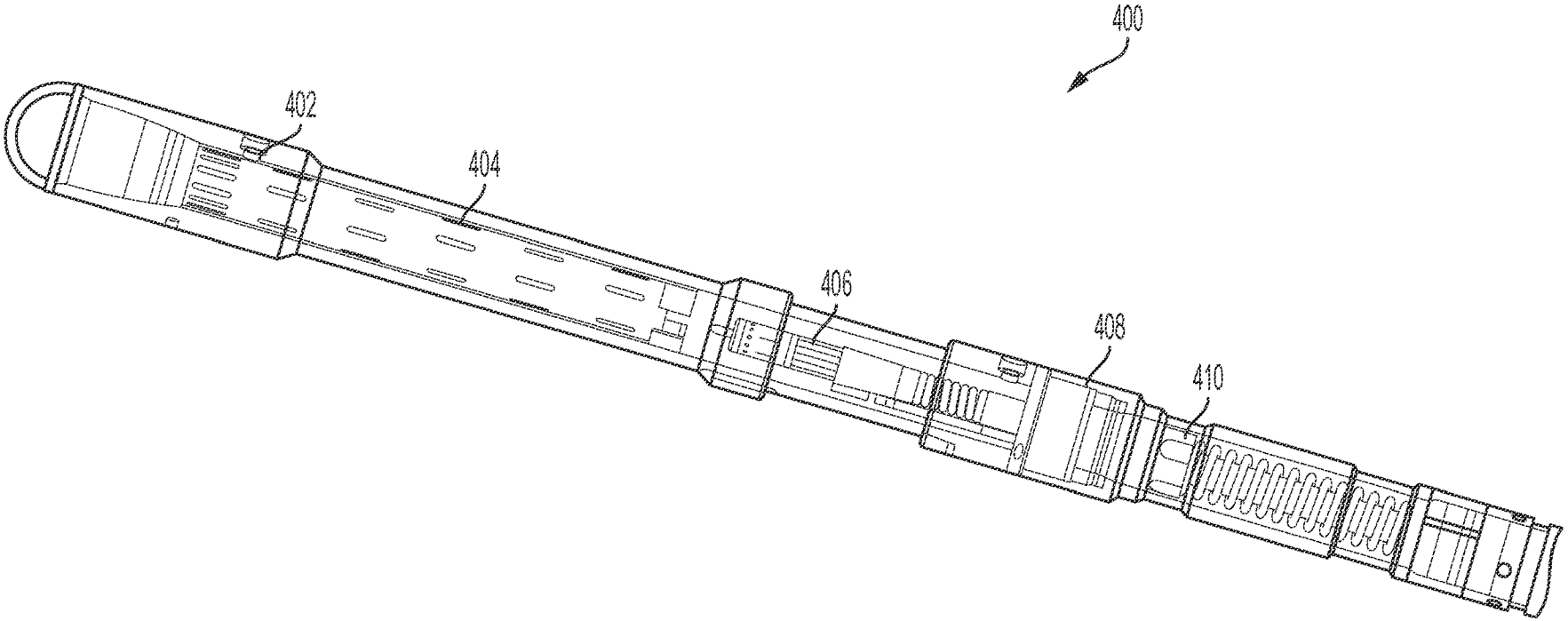
FIG. 4 depicts a cross-sectional view of a wet connect assembly according to some aspects of the invention.

FIG. 4 depicts a cross-sectional view of an example of a wet connect assembly 400 according to one example. The wet connect assembly 400 can be used to establish electrical and hydraulic communication between tubing in a siphon pump chimney and downhole equipment such as a pump or formation tester, as described in examples. The wireline head wet connect 402 can include a spear guide 404 to receive a spear 406 as the wireline head wet connect 402 is lowered within a drill pipe. The spear 406 can be included in the wet latch 408, such that mating the spear 406 with the spear guide 404 results in coupling the wireline head wet connect 402 to the wet latch 408. The wet latch 408 can include purge ports 410 to purge fluid from the wet connect assembly 400, such as when purging buffer fluid from the formation tester.

Figure 5:
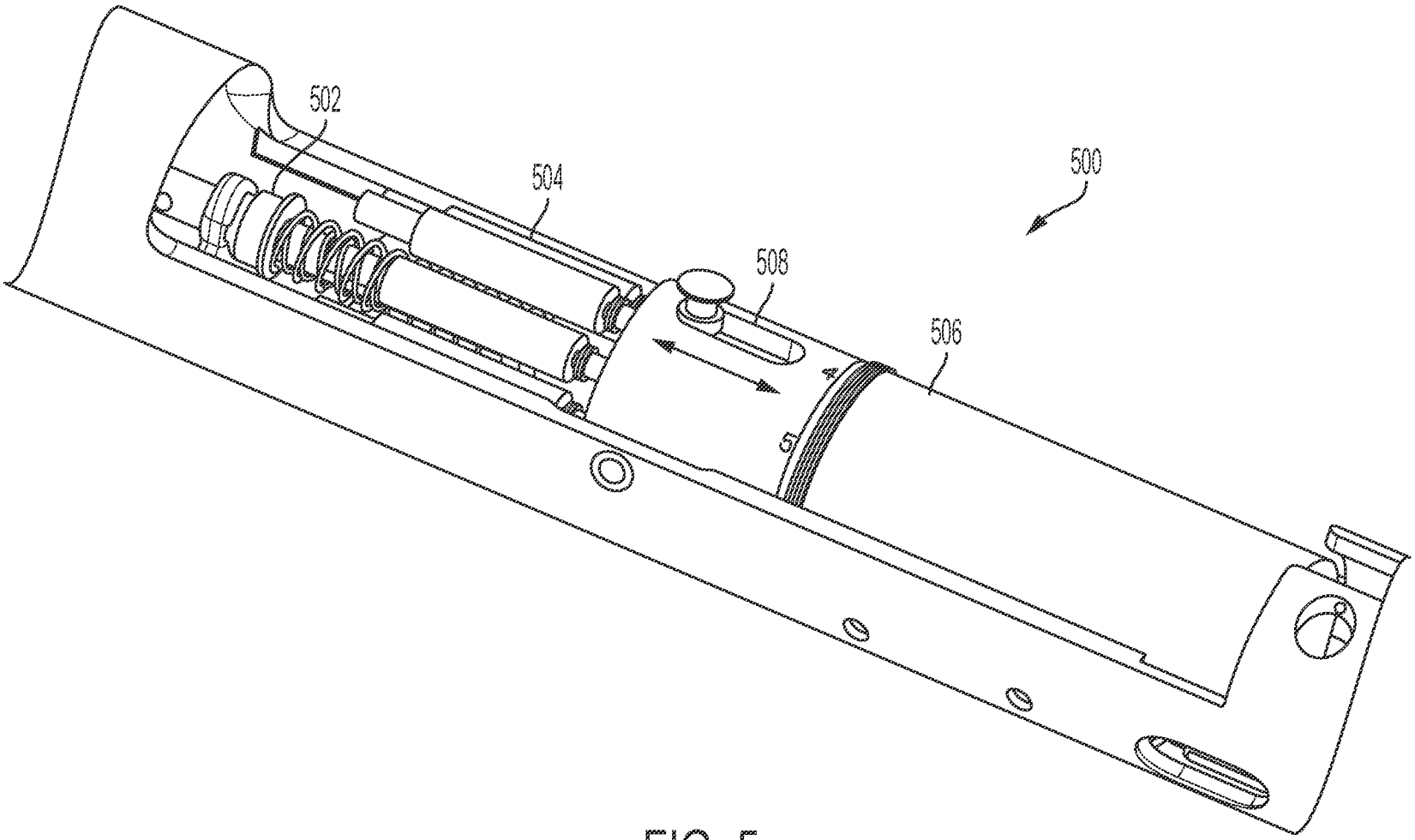
FIG. 5 depicts a perspective view of a wet connect assembly according to some aspects of the invention.

FIG. 5 depicts a perspective view of an example of a wet connect assembly 500 according to one example. FIG. 5 provides a perspective view of the installation and coupling of the wet latch and wireline head wet connect via the spear and spear guide as described in FIG. 4. The spear 502 can include pins 504 to penetrate a rubber boot 506. Penetrating the rubber boot 506 can allow for fluid communication through the wet latch to the wireline head wet connect, so that formation fluid can be conveyed from the formation tester to the siphon pump chimney. The wet latch can include one or more purge ports 508 to purge fluid from the wet connect assembly 500, such as when purging buffer fluid from the formation tester.

Figure 6:
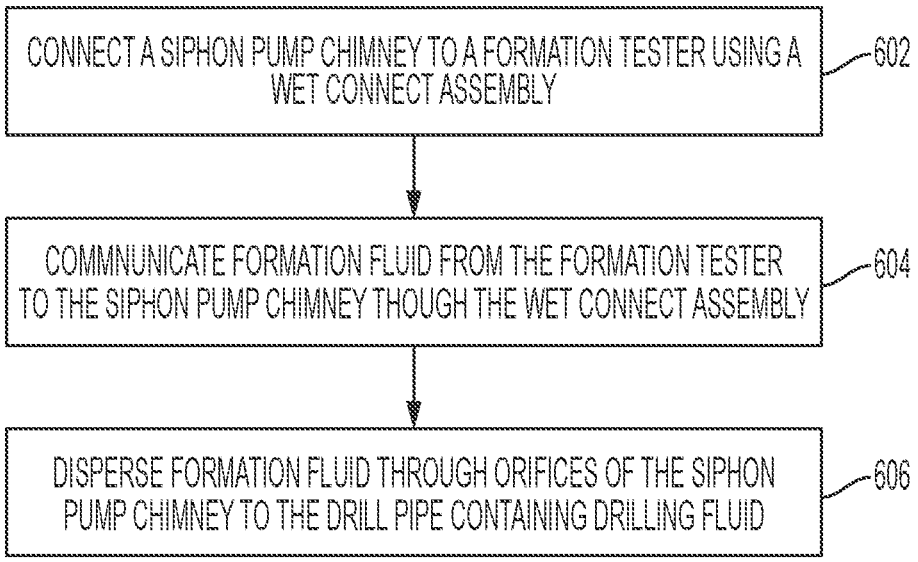
FIG. 6 depicts a flowchart of a process for implementing a siphon pump chimney to increase formation-fluid flow rates during a mini-DST according to some aspects of the invention.

FIG. 6 depicts a flowchart of a process for implementing a siphon pump chimney to increase formation-fluid flow rates during a mini-DST according to one example. Some processes for using a siphon pump chimney with a formation tester to increase formation-fluid flow rates within a wellbore testing environment be described according to previous examples.

In block 602, a siphon pump chimney is connected to a formation tester using a wet connect assembly. A siphon pump chimney can be located within a drill pipe and can be connected to a formation tested located adjacent to a fluid-bearing formation in a wellbore. Connecting the siphon pump chimney to the formation tester to allow for the transfer of formation fluids from the fluid-bearing formation to the siphon pump chimney can include conveying a wireline through a seal of the siphon pump chimney. The wireline, which may be conveyed through coiled tubing, can be coupled to a wet connect of the wet connect assembly. The wireline can be lowered into the wellbore in conjunction with the siphon pump chimney and wet connect until reaching a wet latch. The wet latch can be coupled to or otherwise in fluid communication with an exit port of the formation extender or a formation tester purge port extender. The wet connect can be coupled to the wet latch to electrically connect the formation tester with the wireline. The coupling of the wet connect and wet latch can create a fluid communication path for the formation fluid at the formation tester to be transferred into the siphon pump chimney.

In block 604, formation fluid is communicated from the formation tester to the siphon pump chimney through the wet connect assembly. After establishing a fluid communication path between the formation tester and the siphon pump chimney as described in block 602, the formation fluid can be transferred to the siphon pump chimney. Communicating formation fluid from the formation tester to the siphon pump chimney can include inflating one or more sets of packers around the fluid-bearing formation to isolate the formation fluid from drilling fluid in the wellbore. After inflating the packers, the formation tester can perform formation fluid characteristic measurements.

A pump can be used to pump the formation fluid from the formation tester to the siphon pump chimney through the wet connect assembly. The pump flow rate of the formation fluid can increase as an effective height of the siphon pump chimney increases where the height causes the backing pressure of the pump to decrease. In some examples where the backing pressure of the pump is reduced to a pressure level below the formation pressure, the pump can be bypassed and the formation fluid can flow freely upwards into the siphon pump chimney.

In some examples, prior to pumping formation fluid in a mock-production configuration of a mini-DST, a buffer fluid can be purged from the siphon pump chimney and/or the formation tester using a purge port of the wet connect assembly. The formation tester and siphon pump chimney can be primed with formation fluid prior to dispersing formation fluid into the drill pipe from the siphon pump chimney.

In block 606, formation fluids is dispersed through orifices of the siphon pump chimney to the drill pipe containing drilling fluid. The metered dispersal of the formation fluid into the drill pipe can allow the formation fluid to enter the flow of the drilling fluid. The orifices of the siphon pump chimney can include check valves to prevent the drilling fluid from entering the siphon pump chimney. In some examples, the check valves can disperse the formation fluid within the siphon pump chimney out to the drill pipe at various heights along the siphon pump chimney. This can allow the siphon pump chimney to obtain various effective heights creating variable pressures of the formation fluid column, which in turn can affect the backing pressure on a pump and the resulting formation-fluid flow rates. In some examples, formation fluid at the top of the siphon pump chimney and at the wet connect assembly can be analyzed to detect any changes in the phase of the formation fluid. If changes in the phase of the formation fluid are detected or anticipated, the pressure value within the siphon pump chimney can be adjusted to prevent the formation fluid from phase changing.

In some aspects, systems, devices, and methods for using a siphon pump chimney with a formation tester to increase formation fluid flow rates are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a formation tester to receive formation fluid from a fluid-bearing formation in a wellbore environment; a wet connect assembly positionable to convey the formation fluid from the formation tester to a siphon pump chimney in a drill pipe; and the siphon pump chimney having orifices to disperse the formation fluid from within the siphon pump chimney to the drill pipe.

Example 2 is the system of example 1, the system further comprising: a pump to pump the formation fluid from the formation tester to the siphon pump chimney through the wet connect assembly, the pump having a flow rate of the formation fluid that increases as an effective height of the siphon pump chimney increases.

Example 3 is the system of any of examples 1 to 2, the wet connect assembly comprising: a wet connect that is couplable to a wireline, the wireline being conveyable through a seal of the siphon pump chimney; and a wet latch that is couplable to the wet connect to electrically connect the formation tester with the wireline.

Example 4 is the system of example 3, wherein the wet latch comprises: a purge port to remove buffer fluid from the siphon pump chimney and the formation tester.

Example 5 is the system of example 3, the system further comprising: coiled tubing couplable to the wet connect assembly, wherein the wireline is positionable within the coiled tubing.

Example 6 is the system of any of examples 1 to 5, wherein the orifices comprise: one or more check valves to prevent drilling fluid in the drill pipe from entering the siphon pump chimney, wherein the one or more check valves disperse the formation fluid from within the siphon pump chimney to the drill pipe at heights along the siphon pump chimney.

Example 7 is the system of any of examples 1 to 6, the system further comprising: a first set of packers inflatable around the fluid-bearing formation to prevent the formation fluid at the formation tester from mixing with drilling fluid in the drill pipe; and a second set of packets inflatable around the first set of packers to reduce wellbore pressure noise.

Example 8 is the system of any of examples 1 to 7, wherein the wet connect assembly and the siphon pump chimney comprise: fluid analysis sensors to detect a phase change of the formation fluid.

Example 9 is an assembly comprising: a siphon pump chimney for increasing a flow rate of formation fluid in a wellbore environment, the siphon pump chimney comprising: a tubing to receive formation fluid from downhole equipment, the tubing having a tubing opening to convey the formation fluid in an upwards direction to a tubing head; and the tubing head in a drill pipe, the tubing head having walls creating an annulus extending downwardly around the tubing at a length below the tubing opening such that the formation fluid conveyed in an upwards direction from the tubing opening is flushed into the annulus between the walls and the tubing, wherein the walls include one or more orifices to disperse the formation fluid from the annulus to the drill pipe.

Example 10 is the assembly of example 9, wherein the orifices comprise: one or more check valves to prevent drilling fluid in the drill pipe from entering the assembly, wherein the one or more check valves disperse the formation fluid from within the tubing to the drill pipe at heights along the tubing head.

Example 11 is the assembly of any of examples 9 to 10, wherein a first pressure value of the formation fluid at a top of the tubing head is less than a second pressure value of the formation fluid at a bottom of the tubing, wherein a difference between the first pressure value and the second pressure value is operable to cause a backing pressure of a pump to be lowered, and wherein a lower backing pressure is operable to cause the pump to flow the formation fluid at higher rates.

Example 12 is the assembly of any of examples 9 to 11, the tubing head further comprising: a wireline seal to receive a wireline for operating the downhole equipment.

Example 13 is the assembly of any of examples 9 to 12, wherein the downhole equipment includes a wet connect assembly and a formation tester, the wet connect assembly being couplable to the formation tester and the tubing to convey the formation fluid from a fluid-bearing formation to the tubing.

Example 14 is a method comprising: connecting a siphon pump chimney to a formation tester using a wet connect assembly, the siphon pump chimney being located within a drill pipe and the formation tester being located adjacent to a fluid-bearing formation in a wellbore environment; communicating formation fluid from the formation tester to the siphon pump chimney through the wet connect assembly; and dispersing, through orifices of the siphon pump chimney, the formation fluid into the drill pipe containing drilling fluid.

Example 15 is the method of example 14, wherein communicating formation fluid from the formation tester to the siphon pump chimney further comprises: inflating one or more sets of packers around the fluid-bearing formation; and pumping, using a pump, the formation fluid from the formation tester to the siphon pump chimney through the wet connect assembly, wherein a pump flow rate of the formation fluid increases as an effective height of the siphon pump chimney increases.

Example 16 is the method of any of examples 14 to 15, the method further comprising: preventing, using one or more check valves of the orifices the drilling fluid in the drill pipe from entering the siphon pump chimney, wherein the one or more check valves disperse the formation fluid from within the siphon pump chimney to the drill pipe at heights along the siphon pump chimney.

Example 17 is the method of any of examples 14 to 16, the method further comprising: purging, using a purge port of the wet connect assembly, buffer fluid from the siphon pump chimney and the formation tester; and priming, before dispersing formation fluid into the drill pipe from the siphon pump chimney, the siphon pump chimney and the formation tester with formation fluid.

Example 18 is the method of any of examples 14 to 17, wherein connecting a siphon pump chimney to a formation tester using a wet connect assembly further comprises: conveying a wireline through a seal of the siphon pump chimney; connecting the wireline to a wet connect of the wet connect assembly; and coupling the wet connect to a wet latch of the wet connect assembly to electrically connect the formation tester with the wireline.

Example 19 is the method of example 18, wherein the wireline is conveyed through coiled tubing.

Example 20 is the method of any of examples 14 to 19, further comprising: analyzing the formation fluid at a top of the siphon pump chimney and at the wet connect assembly to detect a phase change of the formation fluid; and adjusting a pressure value within the siphon pump chimney to prevent the formation fluid from phase changing.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a formation tester to receive formation fluid from a fluid-bearing formation in a wellbore environment, the formation fluid comprising a liquid phase and a gas phase;

a wet connect assembly positionable to convey the formation fluid from the formation tester to a siphon pump chimney in a drill pipe, the wet connect assembly further comprising:

a wet connect that is couplable to a wireline, the wireline being conveyable through a seal of the siphon pump chimney, the wet connect comprising a phase separator configurable to separate the liquid phase of the formation fluid from the gas phase of the formation fluid; and a wet latch that is couplable to the wet connect to electrically connect the formation tester within the wireline, wherein the wet latch comprises a purge port to remove buffer fluid from the siphon pump chimney and the formation tester; and coiled tubing couplable to the wet connect assembly, wherein the wireline is positionable within the coiled tubing; and the siphon pump chimney having at least one orifice to disperse the formation fluid from within the siphon pump chimney to the drill pipe.

2. The system of claim 1, the system further comprising:

a pump to pump the formation fluid from the formation tester to the siphon pump chimney through the wet connect assembly, the pump having a flow rate of the formation fluid that increases as an effective height of the siphon pump chimney increases.

3. The system of claim 1, wherein the at least one orifice comprises:

one or more check valves to prevent drilling fluid in the drill pipe from entering the siphon pump chimney, wherein the one or more check valves disperse the formation fluid from within the siphon pump chimney to the drill pipe at heights along the siphon pump chimney.

4. The system of claim 1, the system further comprising;

a first set of packers inflatable around the fluid-bearing formation to prevent the formation fluid at the formation tester from mixing with drilling fluid in the drill pipe; and a second set of packers inflatable around the first set of packers to reduce wellbore pressure noise.

5. The system of claim 1, wherein the wet connect assembly and the siphon pump chimney comprise:

fluid analysis sensors to detect a phase change of the formation fluid.

6. The system of claim 1, the siphon pump chimney further comprising:

a tubing head; and a tubing to receive formation fluid from downhole equipment, the tubing having a tubing opening to convey the formation fluid in an upwards direction to the tubing head, the tubing head having walls defining an annulus between the tubing head and the tubing extending downwardly around the tubing at a length below the tubing opening such that the formation fluid conveyed in an upwards direction from the tubing opening is flushed into the annulus, wherein the walls of the tubing head include one or more orifices to disperse the formation fluid from the annulus to the drill pipe.

7. The system of claim 6, wherein a first pressure value of the formation fluid at a top of the tubing head is less than a second pressure value of the formation fluid at a bottom of the tubing, wherein a difference between the first pressure value and the second pressure value is operable to cause a backing pressure of a pump to be lowered, and wherein a lower backing pressure is operable to cause the pump to flow the formation fluid at higher rates.

8. The system of claim 6, the tubing head further comprising:

a wireline seal to receive the wireline for operating the downhole equipment.

9. An assembly comprising:

a wet connect assembly for conveying formation fluid from a formation tester to a siphon pump chimney in a drill pipe, the formation fluid comprising a liquid phase and a gas phase, the wet connect assembly comprising:

a wet connect that is couplable to a wireline, the wireline being conveyable through a seal of the siphon pump chimney, the wet connect comprising a phase separator configurable to separate the liquid phase of the formation fluid from the gas phase of the formation fluid; and a wet latch that is couplable to the wet connect to electrically connect the formation tester within the wireline, wherein the wet latch comprises a purge port to remove buffer fluid from the siphon pump chimney and the formation tester, wherein the siphon pump chimney comprises at least one orifice for dispersing the formation fluid from within the siphon pump chimney to the drill pipe.

10. The assembly of claim 9, wherein the siphon pump chimney comprises:

a tubing to receive formation fluid from downhole equipment, the tubing having a tubing opening to convey the formation fluid in an upwards direction to a tubing head; and the tubing head in the drill pipe, the tubing head having walls creating an annulus extending downwardly around the tubing at a length below the tubing opening such that the formation fluid conveyed in the upwards direction from the tubing opening is flushed into the annulus between the walls and the tubing.

11. The assembly of claim 10, wherein the at least one orifice comprises:

one or more check valves to prevent drilling fluid in the drill pipe from entering the siphon pump chimney, wherein the one or more check valves disperse the formation fluid from within the siphon pump chimney to the drill pipe at heights along the tubing head.

12. The assembly of claim 10, wherein a first pressure value of the formation fluid at a top of the tubing head is less than a second pressure value of the formation fluid at a bottom of the tubing, wherein a difference between the first pressure value and the second pressure value is operable to cause a backing pressure of a pump to be lowered, and wherein a lower backing pressure is operable to cause the pump to flow the formation fluid at higher rates.

13. The assembly of claim 9, wherein the wet connect assembly and the siphon pump chimney comprise:

fluid analysis sensors to detect a phase change of the formation fluid.

14. The assembly of claim 9, further comprising:

a pump to pump the formation fluid from the formation tester to the siphon pump chimney through the wet connect assembly, the pump having a flow rate of the formation fluid that increases as an effective height of the siphon pump chimney increases.

15. The assembly of claim 9, wherein a first set of packers are inflatable around a fluid-bearing formation to prevent the formation fluid at the formation tester from mixing with drilling fluid in the drill pipe, and wherein a second set of packers is inflatable around the first set of packers to reduce wellbore pressure noise.

16. A method comprising:

connecting a siphon pump chimney to a formation tester using a wet connect assembly, the siphon pump chimney being located within a drill pipe and the formation tester being located adjacent to a fluid-bearing formation in a wellbore environment, by:

conveying a wireline through a seal of the siphon pump chimney, wherein the wireline is conveyed through coiled tubing;

connecting the wireline to a wet connect of the wet connect assembly; and coupling the wet connect to a wet latch of the wet connect assembly to electrically connect the formation tester with the wireline; and communicating formation fluid from the formation tester to the siphon pump chimney through the wet connect assembly, the formation fluid comprising a liquid phase and a gas phase;

separating, using a phase separator of the wet connect, the liquid phase of the formation fluid from the gas phase of the formation fluid;

purging, using a purge port of the wet connect assembly, buffer fluid from the siphon pump chimney and the formation tester; and dispersing, through at least one orifice of the siphon pump chimney, the formation fluid into the drill pipe containing drilling fluid.

17. The method of claim 16, wherein communicating formation fluid from the formation tester to the siphon pump chimney further comprises:

inflating one or more sets of packers around the fluid-bearing formation; and pumping, using a pump, the formation fluid from the formation tester to the siphon pump chimney through the wet connect assembly, wherein a pump flow rate of the formation fluid increases as an effective height of the siphon pump chimney increases.

18. The method of claim 16, further comprising:

preventing, using one or more check valves of the at least one orifice, the drilling fluid in the drill pipe from entering the siphon pump chimney, wherein the one or more check valves disperse the formation fluid from within the siphon pump chimney to the drill pipe at heights along the siphon pump chimney.

19. The method of claim 16, further comprising:

priming, before dispersing formation fluid into the drill pipe from the siphon pump chimney, the siphon pump chimney and the formation tester with formation fluid.

20. The method of claim 16, further comprising:

analyzing the formation fluid at a top of the siphon pump chimney and at the wet connect assembly to detect a phase change of the formation fluid; and adjusting a pressure value within the siphon pump chimney to prevent the formation fluid from phase changing.

* * * * *